US005127458A

United States Patent [19]

Schaefer et al.

[11] Patent Number: 5,127,458

[45] Date of Patent: Jul. 7, 1992

[54] VENETIAN BLIND

[75] Inventors: John F. Schaefer, Corona del Mar; Sandra K. Young, Newport Beach; David C. Burns, San Francisco, all of Calif.

[73] Assignee: Levolor Corporation, Sunnyvale, Calif.

[21] Appl. No.: 493,175

[22] Filed: Mar. 14, 1990

[51] Int. Cl.[5] ..... E06B 9/30

[52] U.S. Cl. ..... 160/168.1; 160/178.1

[58] Field of Search ..... 160/178.1, 168.1, 176.1, 160/173, 177, 166.1, 172, 902

[56] References Cited

U.S. PATENT DOCUMENTS

| | | | |
|---|---|---|---|
| 2,413,464 | 12/1946 | Nihon | 160/173 |
| 2,498,909 | 2/1950 | Bradley | 160/178 |
| 2,545,568 | 3/1951 | Bruner | 160/178.1 |
| 2,573,326 | 10/1951 | Fusco | 160/173 |
| 2,579,137 | 12/1951 | Bruner | 160/173 |
| 2,637,382 | 5/1953 | Nelson | 160/178.1 |
| 2,643,713 | 6/1953 | Mayer | 160/178.1 |
| 2,659,430 | 11/1953 | Lorentzen | 160/173 |
| 2,663,367 | 12/1953 | Lorentzen | 160/173 |
| 2,820,512 | 1/1958 | Yeats | 160/173 |
| 2,860,699 | 11/1958 | Braun | 160/173 |
| 2,868,283 | 1/1959 | Mason et al. | 160/173 |
| 3,485,285 | 12/1969 | Anderle | 160/178.1 X |
| 3,727,665 | 4/1973 | Debs | 160/178 C |
| 4,224,974 | 9/1980 | Anderson et al. | 160/178.1 |
| 4,235,406 | 11/1980 | Vecchiarelli | 160/902 X |
| 4,487,243 | 12/1984 | Debs | 160/168 R |
| 4,607,974 | 8/1986 | Brothers et al. | 160/178.1 X |
| 4,662,596 | 5/1987 | Haarer | 160/902 X |
| 4,719,955 | 1/1988 | Tachikawa et al. | 160/168 R |
| 4,782,882 | 11/1988 | Amedeo et al. | 160/178.1 |
| 4,848,432 | 7/1989 | Connolly | 160/178.1 |
| 4,875,516 | 10/1989 | Marocco | 160/177 X |
| 4,886,102 | 12/1989 | Debs | 160/178.1 X |
| 4,919,185 | 4/1990 | Comeau et al. | 160/178.1 |

FOREIGN PATENT DOCUMENTS

| | | | |
|---|---|---|---|
| 2164986 | 4/1986 | United Kingdom | 160/178.1 |

*Primary Examiner*—David M. Purol

*Attorney, Agent, or Firm*—Skjerven, Morrill, MacPherson, Franklin & Friel

[57] ABSTRACT

The Venetian blind which has a headrail, a series of slats and an extruded bottom rail includes a longitudinal resilient bumper positioned in a bottom longitudinal slat of the bottom rail and extending from the bottom of the rail. Resilient end caps having the same transverse contour as the bumper close the rail ends and together with the bumper, seal the bottom rail from light transmission between it and a window sill and a window vertical edge. An extruded aluminum or plastic headrail with resilient end pieces has spaced tangs extending from a tilt and left mechanism-supporting horizontal bottom wall forming an inverted U-shaped open compartment. This compartment receives the top portion of the uppermost blind slat in a slats tilted closed position to block out light transmission and sight lines under the headrail. A resilient flipper seal obstructs light at the top of the headrail. The bottom rail may also include a storage volume for replacement slats. A resilient sleeve is placed over the tilt wand-to-tilt operator connection to prevent wobbling and rattling of the wand. Each of the resilient bumper, end caps, end pieces and flipper seal all contribute to a black-out blind having improved anti-rattling and anti-abrasion performance.

11 Claims, 4 Drawing Sheets

VENETIAN BLIND

RELATED APPLICATIONS

This application relates to U.S. Ser. No. 07/395,036 filed Aug. 17, 1989 and continuation Ser. No. 07/640,568 filed Jan. 14, 1991 both entitled Window Blinds, Inventor: R. Yannazzone and U.S. Ser. No. 07/498,247 filed Mar. 14, 1990 entitled Window Blind Headrail and Mounting Bracket, Inventor: Schaefer et al. filed herewith, each commonly assigned to Applicants' assignee. The subject matter of these related applications are incorporated herein by reference.

BACKGROUND OF THE INVENTION

This invention relates to an improved Venetian blind. More particularly the invention is directed to an improved headrail, bottom rail and end caps therefor all resulting in a blind that minimizes the transmission of light or presence of sight lines from the blind exterior into the room in the blind tilted closed condition.

As seen in U.S. Pat. No. 4,487,243 Venetian blinds generally comprise a headrail, a series of narrow slats hanging therefrom on string-like ladder assemblies, a window sill-engaging bottom rail, wand-operated means for tilting the slats and a lift cord mechanism for raising and lowering the slats and bottom rail. While the main purpose of the Venetian blind is to control and limit the light and sun entering a room window, the prior art blinds do allow a fair modicum of unwanted light to pass through the blind even in the blind tilted close position. Further, these light passages may give rise to sight lines through the blind offering peep-through passages. The light and sight passages may be present under the bottom rail (U.S. Pat. No. 2,860,699), in the spacing between a window frame and a bottom rail cap (U.S. Pat. No. 4,719,955), between the bottom of a headrail and the top edge of the top slat in a closed condition (U.S. Pat. No. 2,659,430), around the headrail end caps (U.S. Pat. No. 3,727,665), around draw cord clip apertures at the slat ends (U.S. Pat. Nos. 2,413,464 and 2,868,283) and through the vertically aligned draw cord apertures of each slat at two, three or more spaced vertical ladder positions along the slats (FIG. 1 prior art of the related application, Ser. No. 07/395,036).

One of the additional problems of Venetian blinds is the lateral movement of the blinds when lowering and raising and when moved by the wind or by other air or force action. This movement not only is noisy, lets in additional light but also can clip and abrade a window-surround painted or other surface. This problem has been addressed in part by providing resilient caps on the ends of the bottom rail with short bumper legs extending from the caps (U.S. Pat. No. 2,860,699) or anti-rattling slat end resilient caps (U.S. Pat. No. 2,498,909).

In contradistinction to the above prior art the present invention results in a blind which is highly blacked-out in a tilted closed position and is essentially non-rattling. The blind may be economically made and result in a flush and clean construction.

SUMMARY OF THE INVENTION

One aspect of the present invention which contributes to the "black-out" feature is to incorporate a resilient rail bumper positioned in a bottom slot extending over the entire width of the bottom rail. The contoured bumper in cooperation with contour-matching resilient end caps on the ends of the bottom rail not only seals off exterior light and sight lines but also prevents abrasion of the window framed surfaces and blind rattling.

In another aspect of this invention the headrail is made in the form of an extruded open-top housing having integral hook portions for mounting the headrail to a bracket on a window-surround surface as in the related application filed herewith and with depending integral tail portions forming a bottom inverse U-shaped open compartment. The headrail end pieces are preferably made of the same resilient material, such as rubber or resilient plastic, as the bottom rail end pieces. Both effectively seal the ends of the respective rails to the window frame vertical side walls. A resilient flipper seal may also be included at an upper inside edge of the extruded housing to light seal the top of the headrail. The headrail tail portions and end pieces extend downwardly from the bottom horizontal wall of the headrail, which mount the slat lifting and slat raising and lowering operating mechanisms, so that an upper lateral edge of an uppermost one of the series of blind slats extends to a position above a distal end of the depending tail portions in a slats closed position. Since that upper slat edge extends into the inverse U-shaped open compartment at the bottom of the headrail all sight and light lines are blocked under the headrail.

Further, as seen in the earlier filed related application, each of the slats have their lift cord apertures immediately juxtaposed to the ends of the slats, i.e. in the range of about 0.6 to about 2.5 cm. from the slat end. This orientation of the lift cord route holes locates the cords in line with opaque wood or metal portions of the window frame or with drapes on the inside of the blind which may be utilized with the room blind. Even in those windows which are glazed flush with the vertical sides of a window frame such route hole location tends to substantially cut down the field of sight through the holes in a blinds closed condition.

Still another aspect of the invention, particularly to prevent rattling of the tilt mechanism provides a resilient elastomeric sleeve, which surrounds and abuts the connection of the tilt wand to the tilt mechanism. This sleeve preferably is made of the same material, color and texture of the bottom rail end caps and headrail end pieces. The sleeve not only prevents rattling of the wand but also minimizes the wobbling of the tilt wand-to-operator connection.

In yet another feature of the invention the bottom rail has a sufficiently large hollow interior volume so that it may store one or more loose replacement slats which can be removed merely by first removing one of the resilient bottom rail end caps. While in such storage the replacement slats, which normally will have a slat length slightly smaller than the original slat length so they can be accommodated in the bottom rail, are supported on a pair of bumper top ribs extending longitudinally of the bumper. The replacement slats have keyhole like slitted ends which can be guided into position on the lift cords on the outer edges of the series of slats, after a damaged slat has been excised from the blind.

Each of the above features contributes to a blind in which transmission of light through the blind from the room exterior and vice versa is essentially prevented in a blind tilted closed position. This results in a high degree of room darkening. At the same time lines of sight are minimized so that essentially a non-peep blind results. Further the blind is essentially non-rattling contributing to its utility. Additionally the blind has economy of manufacture and assembly while having a crisp, clean appearance.

DETAILED DESCRIPTION

Figure 1A:
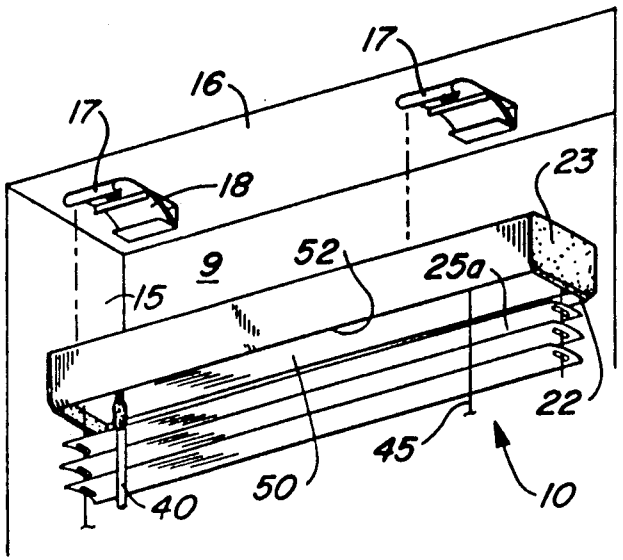
FIG. 1A is a perspective view of a top portion of the blind poised for horizontal mounting on a mounting bracket mounted on a horizontal window-surround surface.
Figure 1:
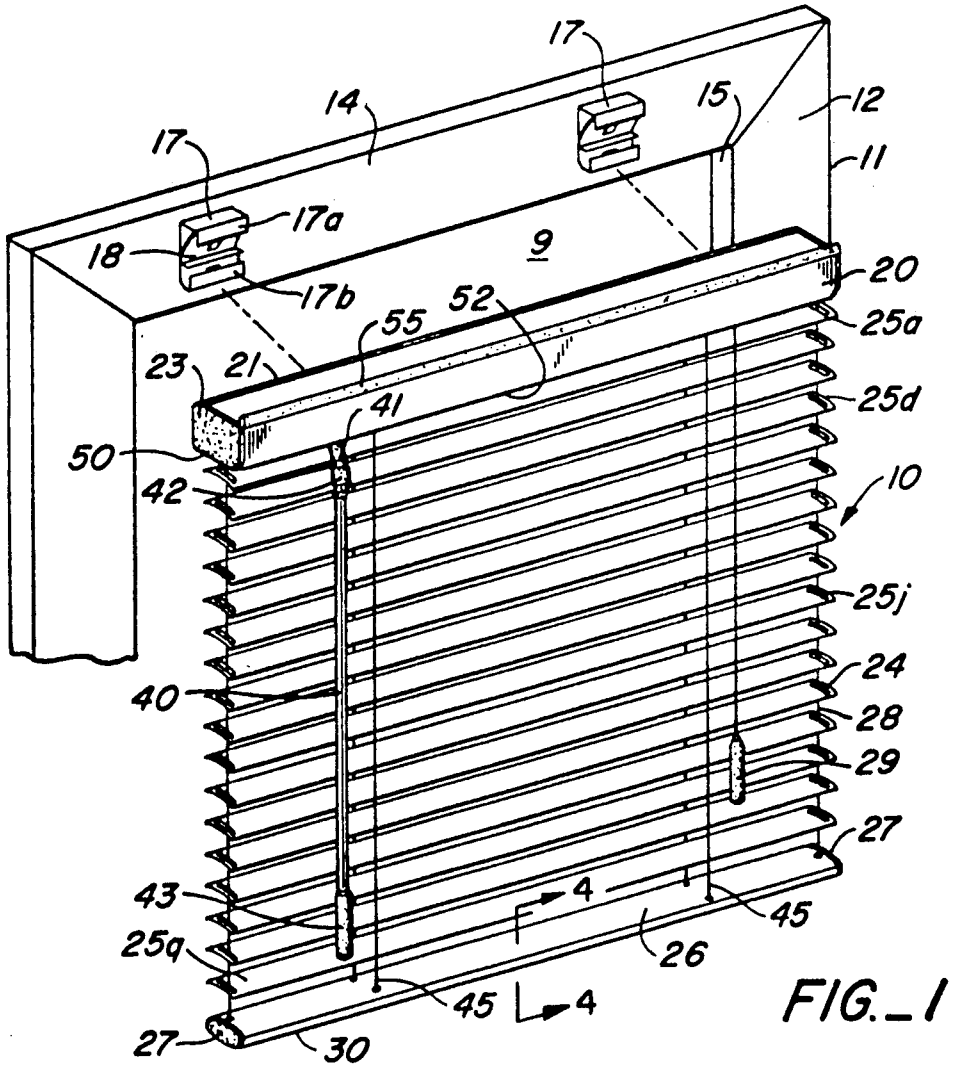
FIG. 1 is a perspective view of the window blind of this invention poised for horizontal mounting on a mounting bracket mounted on a vertical window-surround surface.
Figure 8:
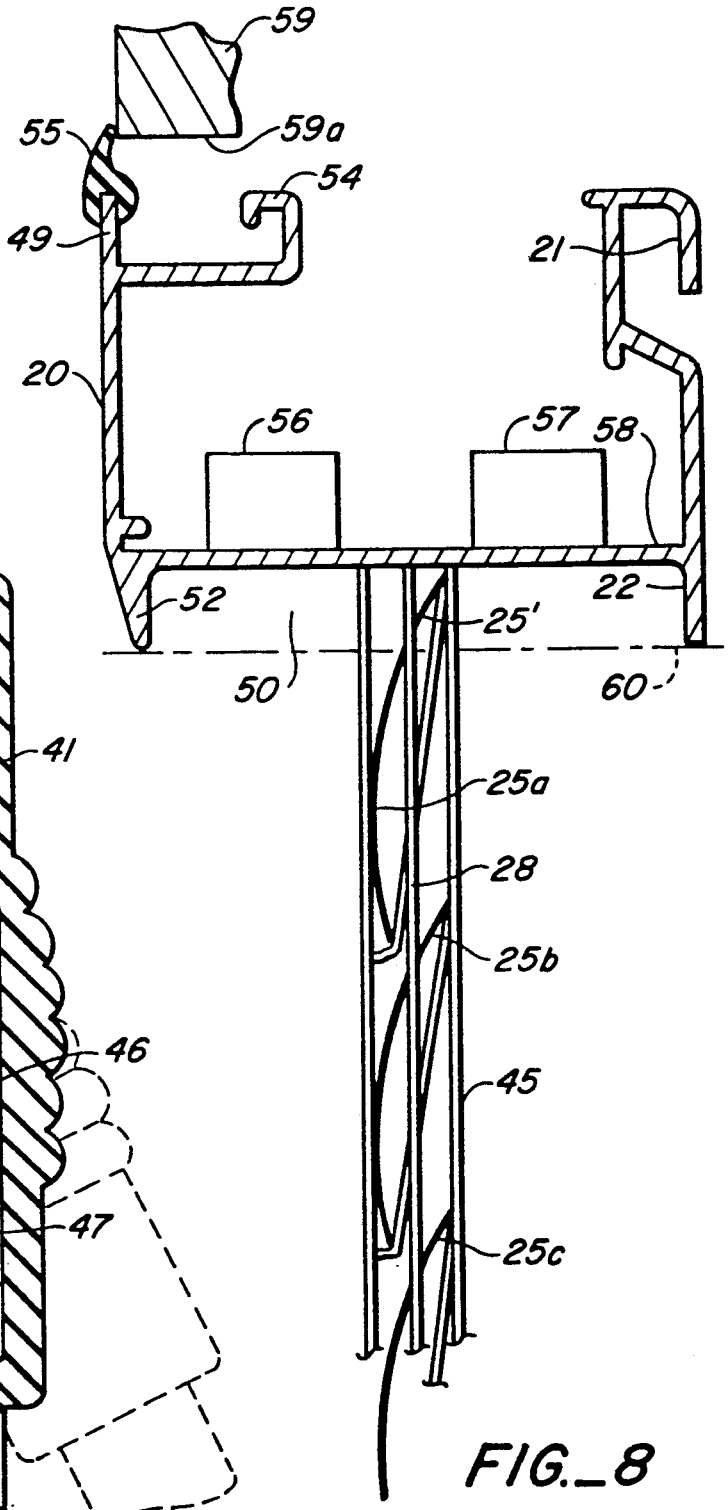
FIG. 8 is a partial cross-sectional view of the extruded headrail showing the slats in a slats closed position.

The Venetian blind 10 of the invention is seen in FIG. 1 in a position about to be mounted in a window frame 11. The blind also may be mounted directly in a window casement or opening. The blind 10 may be mounted on suitable brackets 17 such as those seen in the concurrently filed related application. These brackets may be mounted by suitable screw or other fasteners on a vertical surface such as a planar window frame top 14 or as seen in FIG. 1A on a horizontal surface such as the top 16 of a window recess 9. Each bracket comprises a pair of hooks 17*a* and 17*b* with one hook containing a leaf spring 18. Complementary hooks 21 and 22 as seen most clearly in FIG. 8, are provided extending integrally from a headrail 20 which hooks coact with the bracket hooks and spring to mount and secure the headrail to the brackets. In the FIG. 1A type of mounting hooks 21 and 54 coact with the brackets.

The blind 10 also includes a series of horizontal slats 25*a* through 25*q* each having a slight transverse curvature, a bottom rail 26, a lift cord 28 extending through slat lift cord apertures 24 (sometimes called route holes), slat ladders 45 for supporting and tilting the slats, a pull cord handle 29, a tilt wand 40 with handle 43, a tilt operator 41 and a tilt wand-to operator connection sleeve 42.

Figure 2:
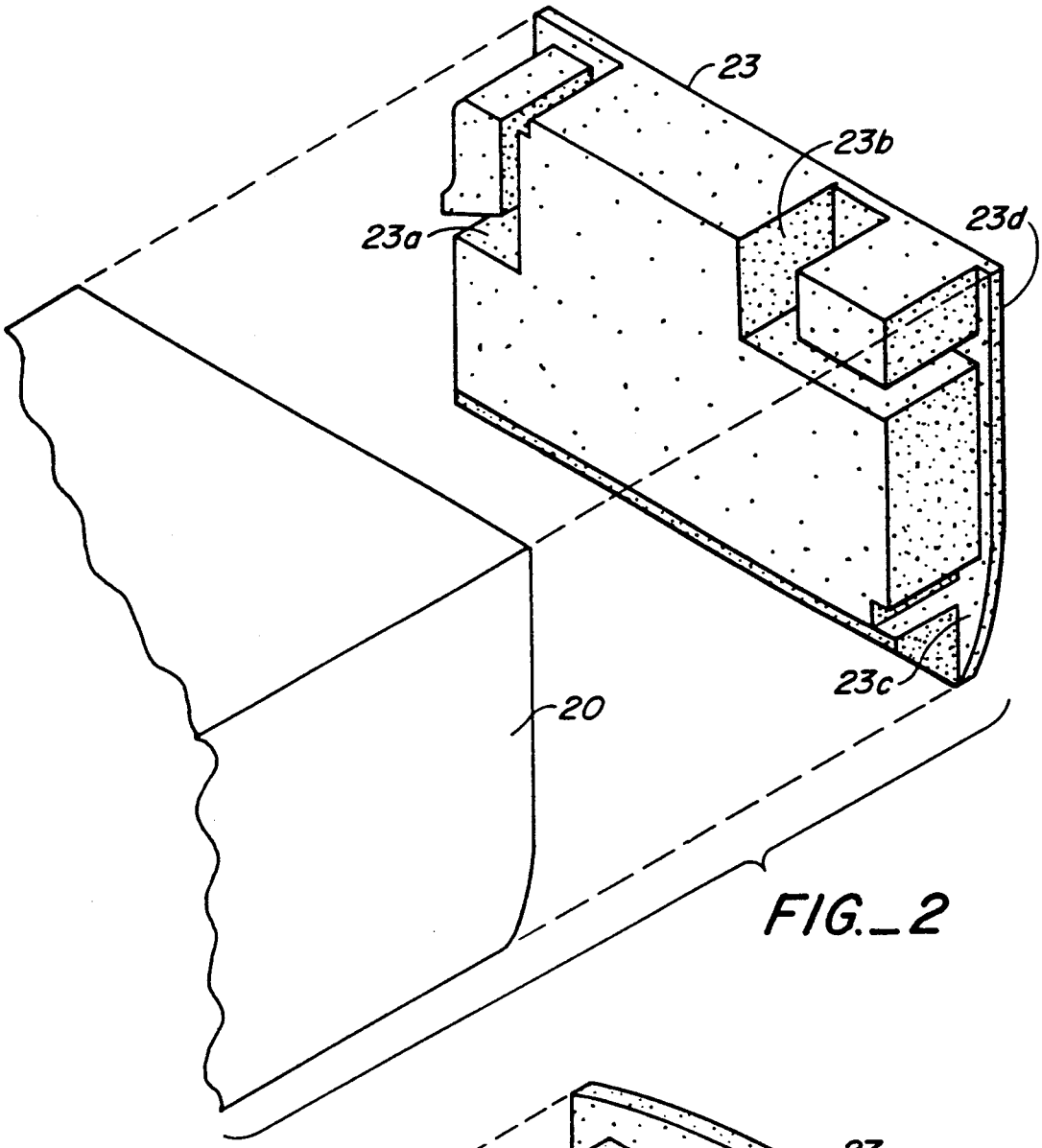
FIG. 2 is a perspective exploded partial view of the blind headrail with a headrail resilient end piece poised for entry into the headrail extrusion.

The headrail 20 preferably is made from an aluminum or plastic extrusion which is then cut-off to form a desired headrail length based on the width of the window to which the blind is to be fitted. Headrail end pieces 23 (FIG. 2), preferably are made from a resilient material such as rubber, synthetic rubber or other resilient plastic such as SANTOPRENE TM, EVOPRENE TM or other thermoplastic elastomer, are hand insertable into the ends of the headrail so that upon installation a planar exterior surface 23*d* of the end pieces is flush sealed with an inside vertical edge 15 of the window frame or window recess. This results in essentially complete blockage of light around the headrail ends. The resiliency of the end pieces tend to compensate for recess surface irregularities caused by slight misalignments of the window frame or from paint humps. Further, the end pieces may be laterally adjusted in the ends of the headrail to provide a proper fit in the window recess but this is not normally necessary if the headrail has been properly sized in length. Cut-outs or grooves, 23*a*, 23*b* and 23*c* are provided in the interior surfaces of the end pieces 23 into which the headrail hook or tang portions 21, 54 and 52, respectively, interfit when the end pieces are inserted into the ends of the headrail 20. Depending from a bottom wall of the extruded housing forming the headrail are two integral tangs 22 and 52 extending longitudinally of the headrail from the lower rear and lower front of the headrail. Tang 22 functions as a mounting hook when the brackets are on a vertical surface (FIG. 1) and forms with tang 52 an inverted U-shaped open compartment 50 extending downwardly from the headrail, the black-out function of which will be described with respect to FIG. 8.

The bottom rail 26 has a longitudinal bottom slot 36 (FIG. 4) into which a longitudinal resilient bumper 30 is pushed so that the bottom edges of the bottom rail forming the slot 36 extend into opposed longitudinal grooves 35 in the bumper sidewalls. The bumper has a transverse convex bottom 31 such that in the slats extended position the convex bottom resiliently seals the rail to a window sill surface 19. The weight of the stack of slats above the bottom rail and the weight of the bottom rail and bumper tends to straighten the convex bumper bottom and afford a relatively wide bumper-to-sill seal extending essentially the full length of the bottom rail.

Figure 3:
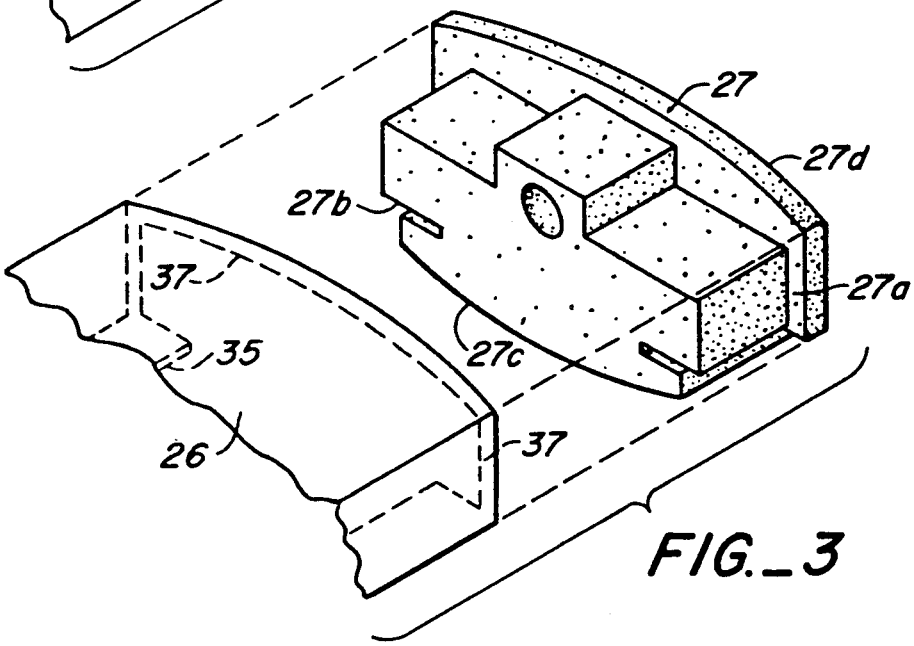
FIG. 3 is a perspective exploded partial view of the blind bottom rail with a bottom rail resilient end cap poised for entry into a bottom rail end.
Figure 6:
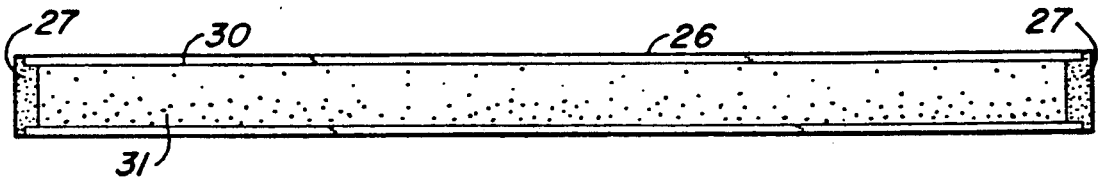
FIG. 6 is an underside view of the bottom rail, resilient bumper and resilient end caps.

As seen in FIG. 1 extruded bottom rail 26 has resilient end caps 27 insertable into each open end. The end caps 27 are seen in detail in FIG. 3. They include an inside edge 27*a*, opposed slits 27*b* which slide inwardly along the distal ends (shown by dash lines) of the bottom of bottom rail 26 until the edge 27*a* abuts the end surface 37 of the bottom rail. As with the headrail end pieces 23 the end caps 27 have a planar outer surface 27*d* which will loosely abut the inside edge 15 of the window opening in both the raised and lowered position of the bottom rail with sufficient clearance that the bottom rail caps outside surfaces will easily pass along surface 15 during the blind raising and lowering operation. The distance which cap 27 is pushed inward into the bottom rail end dictates the resultant clearance. Generally if the window opening is correctly measured the manufactured blind bottom rail length will be such that in the "full in" position of the end cap 27 the proper minimum clearance will be present. The bottom surface 27*c* of the cap 27 has a transverse convex curvature corresponding to the transverse convex surface 31 of the bumper 30 such that the cap contour is an exact continuation of the bumper contour seen in FIG. 6, such that substantially the whole lateral length of the bottom rail and caps blacks out essentially all light transmission under the bottom rail from one vertical edge 15 of the window to the opposite vertical edge. In a slats tilted closed condition the lower edge of the lowermost slat 25*q* abut and seals against the top bottom rail 30 thus obstructing light transmission above the bottom rail.

Figure 4:
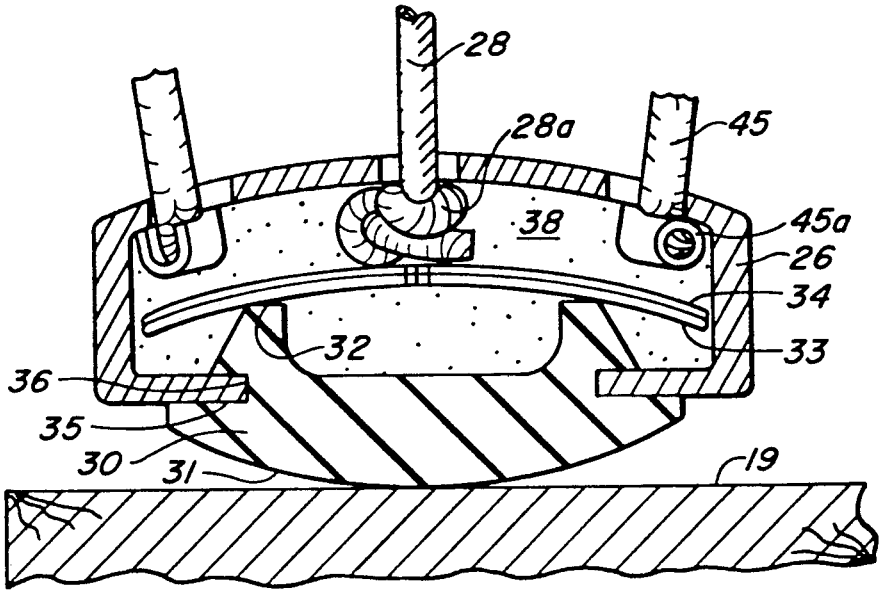
FIG. 4 is a cross-sectional view taken on the line 4—4 of FIG. 1.
Figure 5:
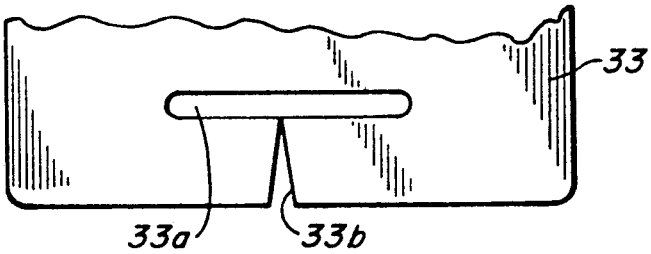
FIG. 5 is a plan view of an end portion of a replacement slat.

Another optional feature of the bottom rail as seen in FIG. 4 is the inclusion of a hollow volume 38 of sufficient extent to store one or more replacement slats 33 and 34 therein. The replacement slats may be loaded through either end of the bottom rail with an end cap removed. The slats may be supported by and guided inwardly by a pair of upstanding integral longitudinal ribs 32 on the top of bumper 30. As shown in FIG. 5 the replacement slats each contain elongated draw cord apertures 33*a* immediately inward of the ends of the slats with a slat slit 33*b* (or key-hole slot) leading therein from the slat end edge. When and if an original equipped slat becomes accidentally bent or kinked the defective slat ends may be cut providing access to route hole 24 so that that the slat can be worked-off the lift cord and slid from the tilt ladders for removal. The replacement slat is removed from its storage position in the bottom rail and the slat slid onto the appropriate ladder rungs and the slat ends worked-on to the lift cord at each end of the slat by slightly separating the slit sides up and down so that the cord goes into slot 33*a* and is prevented from coming out of slat 33*a* by the narrowness of slit 33*b* in a non-separated condition. The bottom rail volume 38 also confines an anchoring knot 28*a* for the lift cord 28 and end anchors 45*a* for the ladders 45.

FIG. 8 illustrates the function of the inverse U-shaped compartment 50 extending from the bottom wall 58 of the extruded headrail 20. Bottom wall 58 supports a blind tilt mechanism 56 and blind raising and lowering mechanism 57, both of conventional construction. When it is desired to fully close the blind the lift cord 28 is operated by pull 29 to lower the bottom rail to the window sill (FIG. 4) and the wand 40 twisted by torque movement of handle 43 (FIG. 1) to tilt the slats in either direction of rotation. The uppermost slat 25*a* is positioned on the slat ladders 45 so that in either full tilted position places the slats in essentially a vertical position which blanks out essentially all light and sight lines since the upper portion 25' of slat 25*a* becomes recessed into compartment 50 and thus extends above the distal ends of tangs 22 and 52. The arrowed sight line 60 is thus blocked by the upper portion 25' of slat 25*a* and no direct light or sight line can be present under the headrail. As an additional black-out feature a flexible flipper seal 55 of the same color, texture and material as the end pieces, end caps and bumpers, extending the length of the headrail 20 may be pushed onto the distal end 49 of the upper front edge of headrail 20. This flipper typically will seal with a wall 59 extending above the top 16 of the window opening to prevent light transmission across the top of the headrail. It can also bend to seal on the top wall 59*a* of a window recess. FIG. 8 also more clearly shows the headrail hooks. Hook 21 is fitted into bracket hook 17*a* compressing spring 18 and the headrail rotated to have headrail hook 54 clear bracket hook 17*b*. Upon release of the headrail the stored energy in the spring locks headrail hook 21 in bracket hook 17*a* and locks headrail hook 54 in bracket hook 17*b* as more fully explained in the second related application. In using a vertically mounted bracket as in FIG. 1 headpiece tang 22 is locked into bracket hook 17*b*.

It can be seen that the above described features provide a blind which is essentially fully blacked-out in the blind down and slats tilted closed condition since provisions have been made to obstruct light transmission and lines of sight around the top, bottom and end walls of the headrail, along the edges of the slats and above, under and at the ends of the bottom rail. There is a normal small (about 0.3 to 0.6 cm) clearance between the slat ends and the window casement. Each of the above described resilient members function also to make the blind non-rattling and non-abrasive to the window-surround surfaces.

Figure 7:
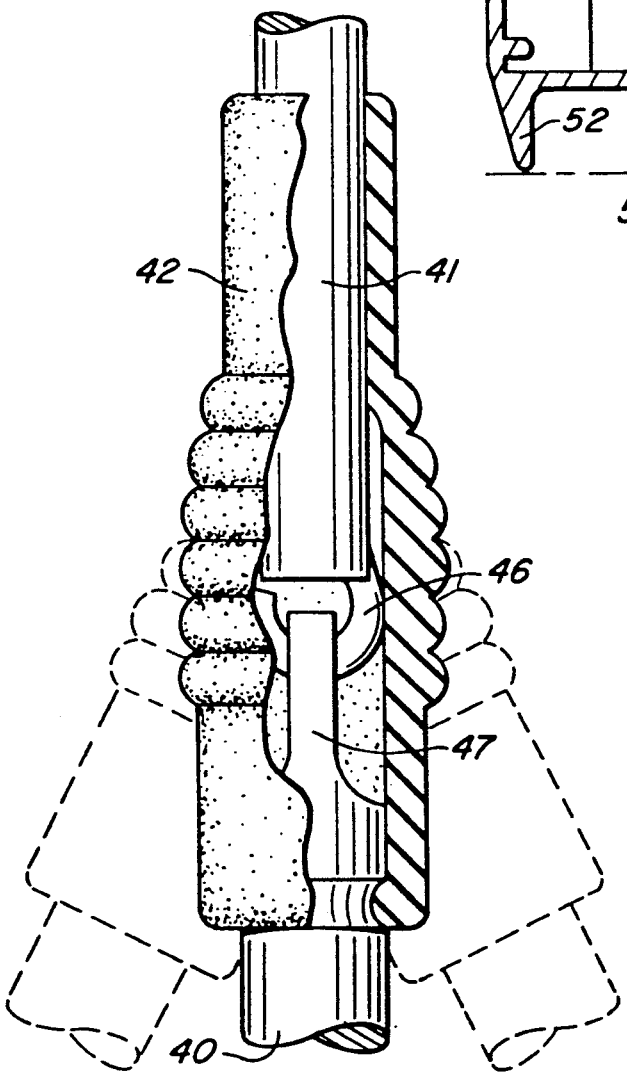
FIG. 7 is a cut-away, half-sectional view of the tilt wand-to-tilt mechanism operator connection with anti-wobble sleeve.

An additional feature of the invention which contributes to the non-rattling feature is the provision of a resilient (rubber or plastic) sleeve extending over and in abutment with the wand-to-tilt operator connection. This sleeve also functions to minimize wobble of the connection. This is shown in FIG. 7 where the wand 40 has an upper apertured end 47 which is connected to a hooked lower end 46 of an operator 41 (rotatable shaft) extending to the tilt mechanism 56 within the headrail enclosure. The inside periphery of resilient sleeve 42 which abuts the wand-to-operator connection takes the slack out of the connection and the wobble normally occasioned during torquing of the wand to operate the tilt mechanism. The tilt mechanism tilts the slat ladders and in turn tilts the slats. As noted by the dash lines the wand and sleeve may be moved over a fairly extensive arc during the torquing operation of the wand and the sleeve prevents accidental disassembly of the wand 40 and operator 41.

The above description of the preferred embodiment of this invention is intended to be illustrative and not limiting Other embodiments of this invention will be obvious to those skilled in the art in view of the above disclosure.

What is claimed is:

1. In a window blind having a fixed headrail, a bottom rail, a series of slats mounted therebetween and extending parallel thereto, means for raising and lowering said bottom rail and said slats, the improvement comprising wherein said bottom rail includes an elongated bottom slot bounded by bottom horizontal edges extending along essentially the longitudinal length of said bottom rail, a flexible rail bumper mounted in said bottom slot and extending under and along essentially the length of said bottom rail, said bumper having opposed longitudinal grooves interfitting with said bottom rail bottom horizontal edges, such that an undersurface of said bumper resiliently seals said bottom rail to a window sill and wherein said bottom rail includes open ends and a removable resilient end cap insertable into each of said open ends, and wherein said end caps each includes an insertable portion having a bottom configuration corresponding to the configuration of said bumper undersurface and abutting respective ends of said bumper when said end caps are inserted into said bottom rail.

2. In a window blind having a fixed headrail, a bottom rail, a series of slats mounted therebetween and extending parallel thereto, means for raising and lowering said bottom rail and said slats, the improvement comprising wherein said headrail is a hollow extrusion having open ends, and including removable resilient end pieces insertable into said open ends and having an outer surface such that said end pieces are resiliently exposed and essentially in fixed abutment to vertical sides of a window frame at an upper edge surface thereof; and wherein said extrusion includes a pair of integral spaced hook portions extending from the top of said headrail for mounting said headrail to a window-surround surface and at least one integral tail portion depending from the bottom of said headrail and wherein said end pieces include an insertable portion having openings configured to conform with said hook portions and said at least one tail portion when inserted into said headrail.

3. In a window blind having a fixed headrail, a bottom rail, a series of slats mounted therebetween and extending parallel thereto, means for raising and lowering said bottom rail and said slats, the improvement comprising wherein said headrail is a hollow extrusion having open ends, and including removable resilient end pieces insertable into said open ends and having an outer surface such that said end pieces are resiliently exposed and essentially in fixed abutment to vertical sides of a window frame at an upper edge surface thereof; and wherein said headrail includes an elongated box enclosure enclosing operating mechanisms for said means for lowering and raising said bottom rail and said slats and a means for tilting said slats, said enclosure having a bottom horizontal wall extending above said slats and having at least one elongated tail portion extending substantially along the entire width of said enclosure and depending from an end of said bottom wall wherein an upper lateral edge of an uppermost one of said slats extends to a position above a distal end of said at least one depending tail portion in a slats closed position of said window blind such that sight and light lines are blocked under said headrail by said at least one tail portion.

4. The window blind of claim 3 in which said at least one tail portion depends from a room-facing vertical wall of said headrail enclosure.

5. The window blind of claim 3 in which said at least tail portion depends form a window-facing vertical wall of said headrail enclosure.

6. The window blind of claim 3 comprising a pair of tang portions depending from said bottom wall and forming an open compartment for reception of said lateral edge of said uppermost slat.

7. The window blind of claim 3 further including means for mounting said headrail comprising a wall-mounted bracket, said bracket including a hook portion and wherein one of said tang portions is insertable into said bracket hook portion to lock said headrail horizontally with respect to said bracket, said bracket being essentially concealed by said headrail.

8. In a window blind having a fixed headrail, a bottom rail, a series of slats having closed cord apertures at the respective ends of each slat, mounted therebetween and extending parallel thereto, means for raising and lowering said bottom rail and said slats and means for tilting said slats, the improvement comprising a least one additional replacement slat and wherein said bottom rail has at least one removable end piece and a hollow interior volume sufficient to store said at least one additional replacement slat therein, said at least one replacement slat being removable from said hollow interior volume through an end of said bottom rail after removal of an associated end piece and wherein said replacement slat includes a pair of edge slots for mounting said replacement slat into said series of slats in place of a removed one of said series of slats.

9. The window blind of claim 8 in which said bottom rail includes an elongated bottom slot extending along essentially the length of said bottom rail, and a flexible rail bumper mounted in said bottom slot and extending longitudinally under the length of said bottom rail such that an undersurface of said bumper resiliently seals said bottom rail to a window sill.

10. The window blind of claim 9 wherein said bumper includes at least one upper rib partially extending into said bottom rail interior volume and forming a support surface for said replacement slat therein.

11. The window blind of claim 8 wherein said means for lowering and raising includes a pull cord extending through said cord apertures, said edge slots of said replacement slat having a key-hole configuration such that said pull cord can be guided into a closed end of each key-hole slot.

* * * * *

UNITED STATES PATENT AND TRADEMARK OFFICE

CERTIFICATE OF CORRECTION

PATENT NO. : 5,127,458

DATED : July 7, 1992

INVENTOR(S) : John F. Schaefer, Sandra K. Young and David C. Burns

It is certified that error appears in the above-identified patent and that said Letters Patent is hereby corrected as shown below:

Col. 7, line 31, change "form" to --from--.

Col. 7, line 34, change "tang" to --tail--.

Col. 8, line 1, change "tang" to -tail--.

Signed and Sealed this

Fourth Day of January, 1994

*Attest:*

Bruce Lehman

BRUCE LEHMAN

*Attesting Officer*

*Commissioner of Patents and Trademarks*